US010816923B2

(12) United States Patent
Morino

(10) Patent No.: US 10,816,923 B2
(45) Date of Patent: Oct. 27, 2020

(54) PRINT HEAD AND IMAGE FORMING APPARATUS

(71) Applicant: TOSHIBA TEC KABUSHIKI KAISHA, Shinagawa-ku, Tokyo (JP)

(72) Inventor: Shigeru Morino, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/516,578

(22) Filed: Jul. 19, 2019

(65) Prior Publication Data

US 2020/0064763 A1 Feb. 27, 2020

(30) Foreign Application Priority Data

Aug. 24, 2018 (JP) ..... 2018-157371

(51) Int. Cl.
*G03G 15/32* (2006.01)
*G03G 15/00* (2006.01)

(52) U.S. Cl.
CPC ..... *G03G 15/326* (2013.01); *G03G 15/50* (2013.01)

(58) Field of Classification Search
CPC ..... G03G 15/326; G03G 15/50
See application file for complete search history.

(56) References Cited

U.S. PATENT DOCUMENTS

2007/0211241 A1* 9/2007 Aizawa ..... H01L 22/12 356/237.2
2007/0236553 A1* 10/2007 Kawano ..... G03G 15/04072 347/133
2015/0202887 A1* 7/2015 Imai ..... B41J 2/447 347/225

FOREIGN PATENT DOCUMENTS

JP H11-245441 A 9/1999

* cited by examiner

*Primary Examiner* — Lamson D Nguyen
(74) *Attorney, Agent, or Firm* — Foley & Lardner LLP

(57) ABSTRACT

A print head includes a memory, an input and output unit, and a plurality of light emitting elements. The memory is configured to store a first light quantity value obtained by measuring a light quantity of each of the plurality of light emitting elements when supplied with a first reference current value, and a light quantity difference value between the first light quantity value and a second light quantity value obtained by measuring a light quantity of each of the plurality of light emitting elements when supplied with a second reference current value. The input and output unit is configured to output the first light quantity value and the light quantity difference value and receive a correction value determined based on the first light quantity value and the light quantity difference value. The light emitting elements are configured to emit light based on a correction current value corresponding to the correction value.

20 Claims, 8 Drawing Sheets

PRINT HEAD AND IMAGE FORMING APPARATUS

CROSS-REFERENCE TO RELATED APPLICATIONS

This application is based upon and claims the benefit of priority from Japanese Patent Application No. 2018-157371, filed Aug. 24, 2018, the entire contents of which are incorporated herein by reference.

FIELD

Embodiments described herein relate generally to a print head and an image forming apparatus.

BACKGROUND

Printers, copying machines, and multi-function peripherals (MFP) using an electrophotographic process are known. As an exposure means (exposure unit) of these apparatuses, a print head is known. In the print head, a photosensitive drum is exposed to the light output from a plurality of light emitting elements such as light emitting diodes (LEDs).

Since the print head adopts a structure in which light emitted from the plurality of light emitting elements form an image on a photosensitive drum using a small lens called a rod lens array that forms an erect image, the print head can be miniaturized. In addition, since there is no moving part, the print head has low energy consumption and is a silent exposure unit.

As the print head, not only a print head using LEDs (in which LED chips are arranged) but also a print head using organic LEDs (OLED: Organic Light Emitting Diode) are developed.

In the print head using LEDs, in general, LED chips are arranged on a printed circuit board. In the print head using organic LEDs, the organic LEDs are collectively formed on a substrate using a mask, and thus the light emitting elements can be accurately arranged. For example, an example in which a plurality of light emitting elements composed of organic LEDs is formed on a glass substrate is known.

A plurality of light emitting elements of the print head correspond to one line in a main scanning direction, and each of the light emitting elements emits light based on pixel information read from a page memory.

For example, a print head corresponding to 1200 dots-per-inch (dpi) and A3 size includes 15400 light emitting elements arranged in one line. When there is a variation in the light quantities of the light emitting elements, density unevenness may occur in a printed image. Therefore, a technique of correcting the light quantities based on light quantity correction values of the respective light emitting elements to make the light quantities of the respective light emitting elements uniform is adopted.

In the print head, in order to correct the light quantity of each of the light emitting elements, light quantity characteristic data indicating a relationship between a current value of each of the light emitting elements and a measured value of the light quantity is stored, and each of the light emitting elements emits light based on a correction value calculated from the light quantity characteristic data. As described above, the number of light emitting elements is extremely large, and the light quantity characteristic data is stored for each of the light emitting elements. Under these circumstances, the improvement of a technique of efficiently storing the light quantity characteristic data is required.

DETAILED DESCRIPTION

Embodiments provide a print head and an image forming apparatus, which can efficiently store light quantity characteristic data.

In general, according to one embodiment, there is provided a print head including a memory, an input and output unit, and a plurality of light emitting elements. The memory is configured to store a first light quantity value obtained by measuring a light quantity of each of light emitting elements that emit light when supplied with a first reference current value corresponding to a first measurement reference value, and a light quantity difference value between the first light quantity value and a second light quantity value obtained by measuring a light quantity of each of light emitting elements that emit light when supplied with a second reference current value corresponding to a second measurement reference value. The input and output unit is configured to output the first light quantity value and the light quantity difference value and to input a correction value obtained from the first light quantity value and the light quantity difference value. The plurality of light emitting elements is configured to emit light based on a correction current value corresponding to the correction value.

Figure 1:
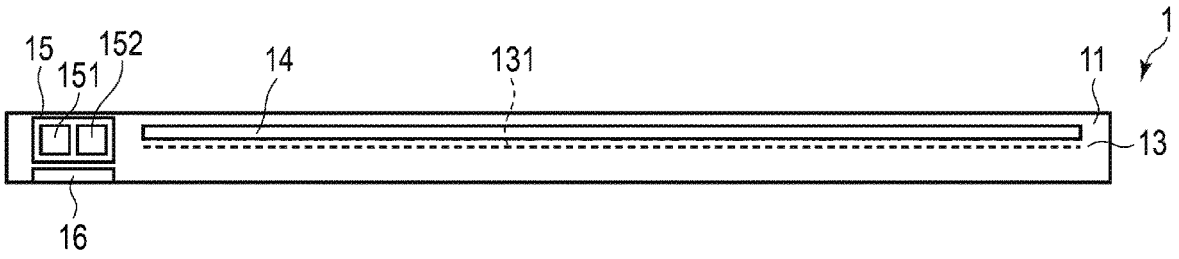
FIG. 1 is a diagram illustrating an example of a schematic configuration of a print head common to respective embodiments.

FIG. 1 is a diagram illustrating an example of a schematic configuration of a print head common to respective embodiments. As illustrated in FIG. 1, a print head 1 includes a transparent substrate 11. The transparent substrate 11 is a glass substrate that allows transmission of light, and a light emitting element array 13 is formed in a center portion of the transparent substrate 11 along a longitudinal direction of the transparent substrate 11. The light emitting element array 13 is configured with a plurality of light emitting elements 131

(e.g., OLEDs). For example, the print head 1 corresponding to 1200 dpi and A3 size includes 15400 light emitting elements 131 that are arranged in one line.

A drive circuit array 14 is formed in the vicinity of the light emitting element array 13. The drive circuit array 14 includes a plurality of drive circuits corresponding to the plurality of light emitting elements 131, and the drive circuit drives the light emitting element 131 to emit light. FIG. 1 illustrates an example in which the drive circuit array 14 is arranged on a single side of the light emitting element array 13. However, the drive circuit array 14 may be arranged on both sides centering on the light emitting element array 13.

In addition, the transparent substrate 11 includes a control circuit 15, and the control circuit 15 includes a first memory 151 and a second memory 152. For example, the first memory 151 is a non-volatile memory and stores data such as a measured value of the light quantity. The second memory 152 is a volatile memory and stores a correction value or the like. The measured value of the light quantity and the correction value and the like will be described below in detail. Further, the control circuit 15 includes a digital to analog (D/A) converter circuit, a selector, and an address counter. The D/A converter circuit, the selector, and the address counter supply a signal for controlling the light intensity or ON/OFF of each of the light emitting elements 131 to each of the drive circuits of the drive circuit array 14.

In addition, the transparent substrate 11 includes a connector 16. The connector 16 is a signal input and output unit through which the print head 1 and an image forming apparatus such as a printer, a copying machine, or a multi-function peripheral are electrically connected to each other. For example, the connector 16 outputs data stored in the first memory 151 to the image forming apparatus or inputs data from the image forming apparatus. The second memory 152 stores data input through the connector 16. For example, a substrate for sealing each of the light emitting elements, each of the drive circuits, and the like in order to prevent contact with outside air is attached to the transparent substrate 11.

Figure 2:
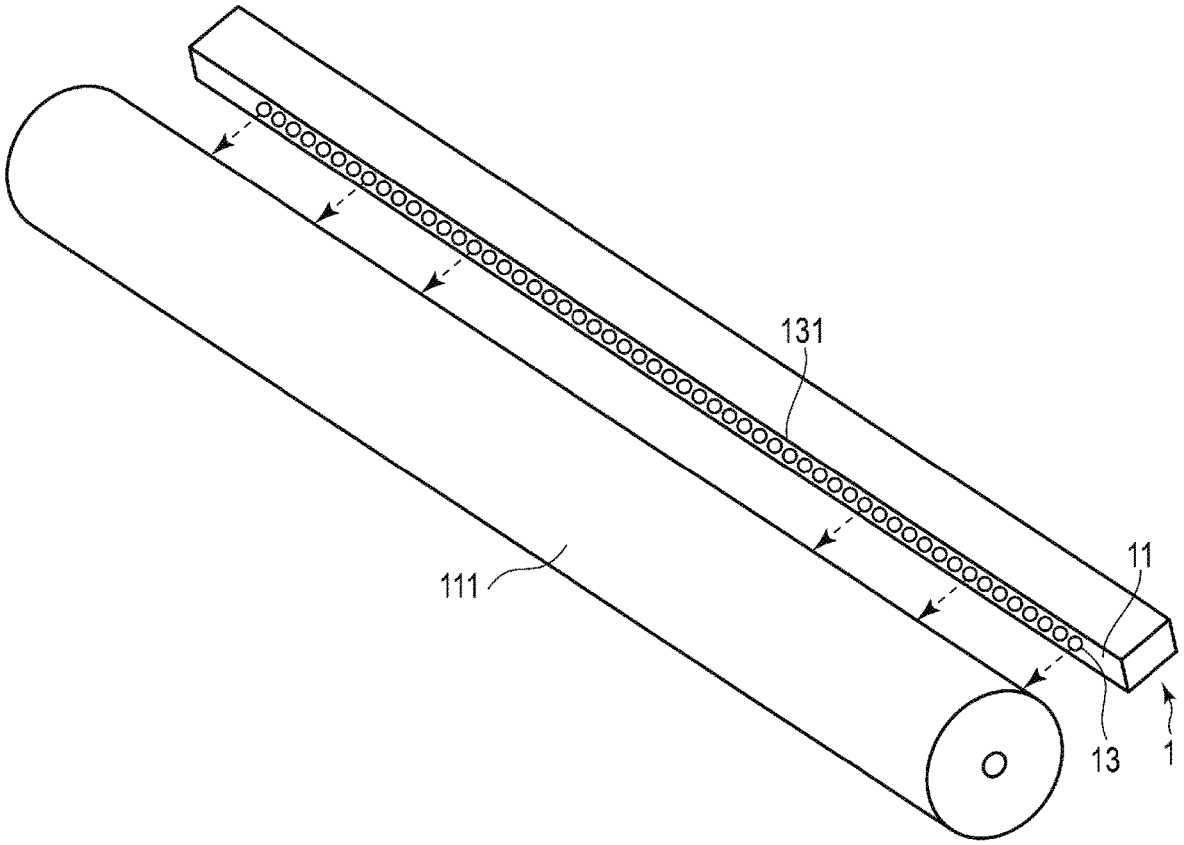
FIG. 2 is a diagram illustrating an example of a positional relationship between the print head to the respective embodiments and a photosensitive drum.

FIG. 2 is a diagram illustrating an example of a positional relationship between the print head common to the respective embodiments and a photosensitive drum. As illustrated in FIG. 2, the image forming apparatus includes a photosensitive drum 111 and is configured such that the print head 1 can be mounted thereon. When the print head 1 is mounted on the image forming apparatus, the mounted print head 1 faces the photosensitive drum 111.

Light emitted from the plurality of light emitting elements 131 of the print head 1 is incident into an incidence surface (lens surface) of a rod lens array, passes through the rod lens array, and is focused on the photosensitive drum 111.

The photosensitive drum 111 is uniformly charged by a charging unit and is exposed to light emitted from the plurality of light emitting elements 131, thereby decreasing the potential thereof. That is, by controlling light emission and non-emission of light of the plurality of light emitting elements 131, an electrostatic latent image can be formed on the photosensitive drum 111.

Figure 3:
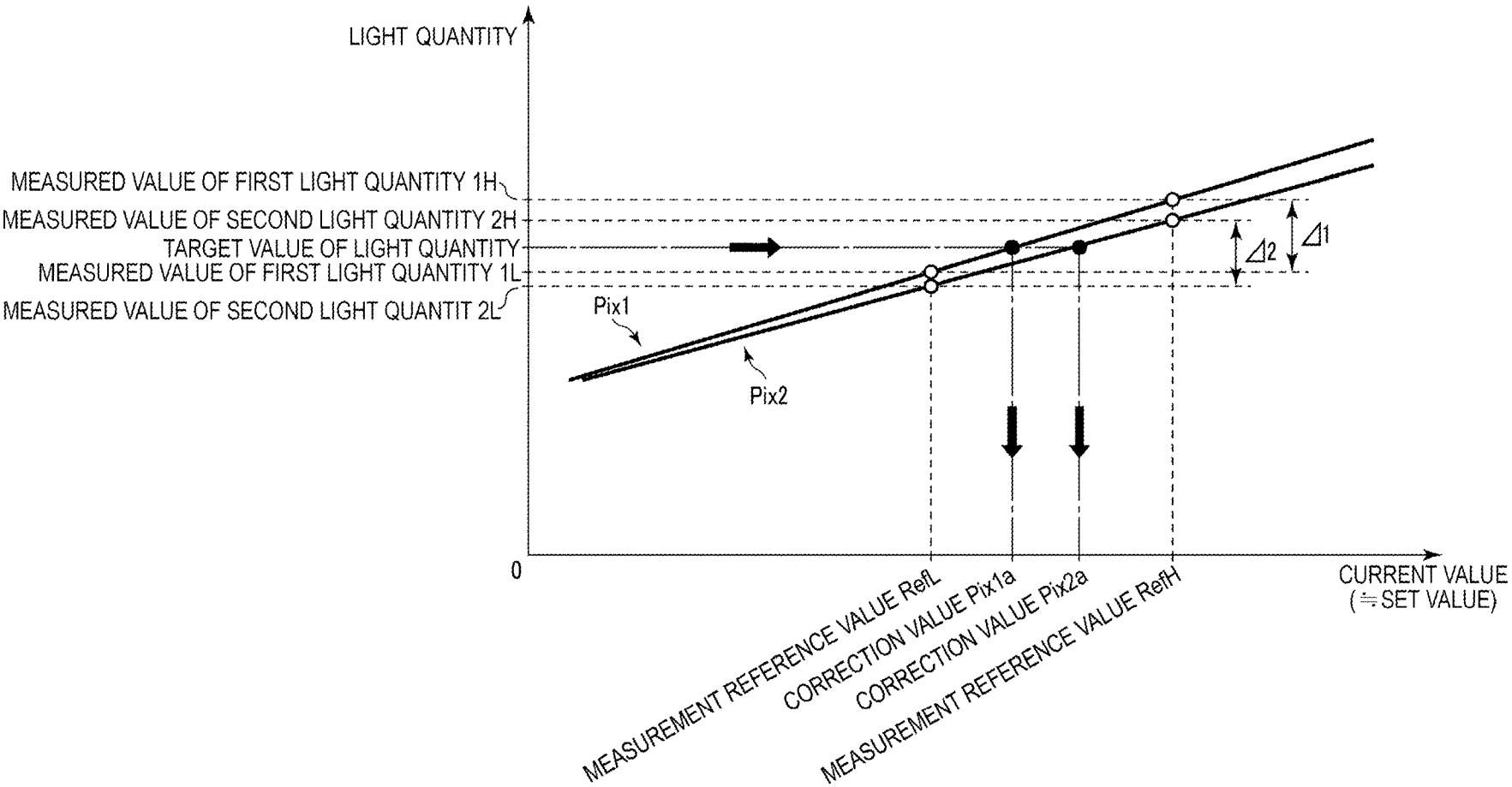
FIG. 3 is a diagram illustrating an example of characteristics of light quantities and current values of light emitting elements of a print head according to a first embodiment.

FIG. 3 is a diagram illustrating an example of characteristics of light quantities and current values of light emitting elements of a print head according to a first embodiment. After manufacturing the print head, characteristics of light quantities and current values of all the light emitting elements 131 corresponding to all the pixels are detected by a light quantity measuring device, and the characteristic detection results are stored. As illustrated in FIG. 3, the characteristics of light quantities and the current values of the light emitting elements are represented by substantially straight lines. Accordingly, if two points can be plotted, a characteristic graph (y=ax+b) can be estimated, and an input value (current value) for obtaining a target light quantity can be calculated. In the embodiment, for easy understanding, focusing on two pixels (Pix1 and Pix2), a case where characteristics of light quantities and current values of first and second light emitting elements corresponding to the two pixels are detected and the characteristic detection results are stored will be mainly described.

As illustrated in FIG. 3, the light quantity measuring device supplies a first reference current value corresponding to a measurement reference value RefL (first measurement reference value) and a second reference current value corresponding to a measurement reference value RefH (second measurement reference value) to a first light emitting element, thereby causing the first light emitting element to emit light. For example, the first reference current value is assumed to be a value lower than the second reference current value. The light quantity measuring device measures and records a measured value of a first light quantity 1L as a light quantity of the first light emitting element that emits light when supplied with the first reference current value. In addition, the light quantity measuring device measures and records a measured value of a first light quantity 1H as a light quantity of the first light emitting element that emits light when supplied with the second reference current value.

Likewise, the light quantity measuring device supplies a first reference current value corresponding to a measurement reference value RefL (first measurement reference value) and a second reference current value corresponding to a measurement reference value RefH (second measurement reference value) to a second light emitting element, thereby causing the second light emitting element to emit light. The light quantity measuring device measures and records a measured value of a second light quantity 2L as a light quantity of the second light emitting element that emits light when supplied with the first reference current value. In addition, the light quantity measuring device measures and records a measured value of a second light quantity 2H as a light quantity of the second light emitting element that emits light when supplied with the second reference current value.

In addition, the light quantity measuring device converts the measured values of light quantities and records the converted values. For example, the light quantity measuring device calculates a light quantity difference value Δ1 based on the measured value of the first light quantity 1L and the measured value first light quantity 1H (Δ1=1H−1L). "Δ" represents delta. In addition, the light quantity measuring device stores the measured value of the first light quantity 1L and the calculated light quantity difference value Δ1 (light quantity characteristic data D11: 1L, Δ1).

Likewise, the light quantity measuring device calculates a light quantity difference value Δ2 based on the measured value of the second light quantity 2L and the second light quantity measured value 2H (Δ2=2H−2L). In addition, the light quantity measuring device stores the measured value of the second light quantity 2L and the calculated light quantity difference value Δ2 (light quantity characteristic data D12: 2L, Δ2).

In order to make the light quantities of the plurality of light emitting elements 131 of the print head 1 substantially uniform, a target light quantity value is set as illustrated in FIG. 3, and a processor mounted on the image forming apparatus or the like calculates a correction value Pix1*a* for obtaining the target light quantity value from the measured value of the first light quantity 1L and the light quantity difference value Δ1. Likewise, the processor calculates a correction value Pix2*a* for obtaining the target light quantity value from the measured value of the second light quantity 2L and the light quantity difference value Δ2. The print head 1 supplies a first correction current value corresponding to the correction value Pix1*a* to the first light emitting element and a second correction current value corresponding to the correction value Pix2*a* to the second light emitting element. As a result, the target light quantity can be obtained from the first and second light emitting elements of the print head 1.

Due to various factors such as the accuracy of light quantity measurement, the accuracy of correction value calculation, and the accuracy of a current value variable control, it is difficult to completely match the light quantities of all the light emitting elements 131 to the target light quantities. In considering these factors, it is sufficient to substantially match the light quantities of all the light emitting elements 131 to the target light quantities such that density unevenness of a printed image cannot be recognized by the visual inspection. Tolerance of the substantial match may be set to be narrow or wide depending on the quality required for the printed image.

The light quantity measuring device outputs the light quantity characteristic data D11 and D12 to the print head 1. The print head 1 receives the light quantity characteristic data D11 and D12 through the connector 16, and the first memory 151 stores the light quantity characteristic data D11 and D12. As described above, the print head 1 stores the characteristics detection results of the light quantities and the current values of the plurality of light emitting elements 131. In the print head 1, the characteristics of the light quantities and the current value vary depending on the individual print heads 1 and also vary depending on the individual light emitting elements. Accordingly, the light quantity measuring device detects characteristics of each of the light emitting elements of each of the print heads 1, and stores the characteristic detection result of each of light emitting elements of a predetermined print head 1 in the predetermined print head 1.

Figure 4:
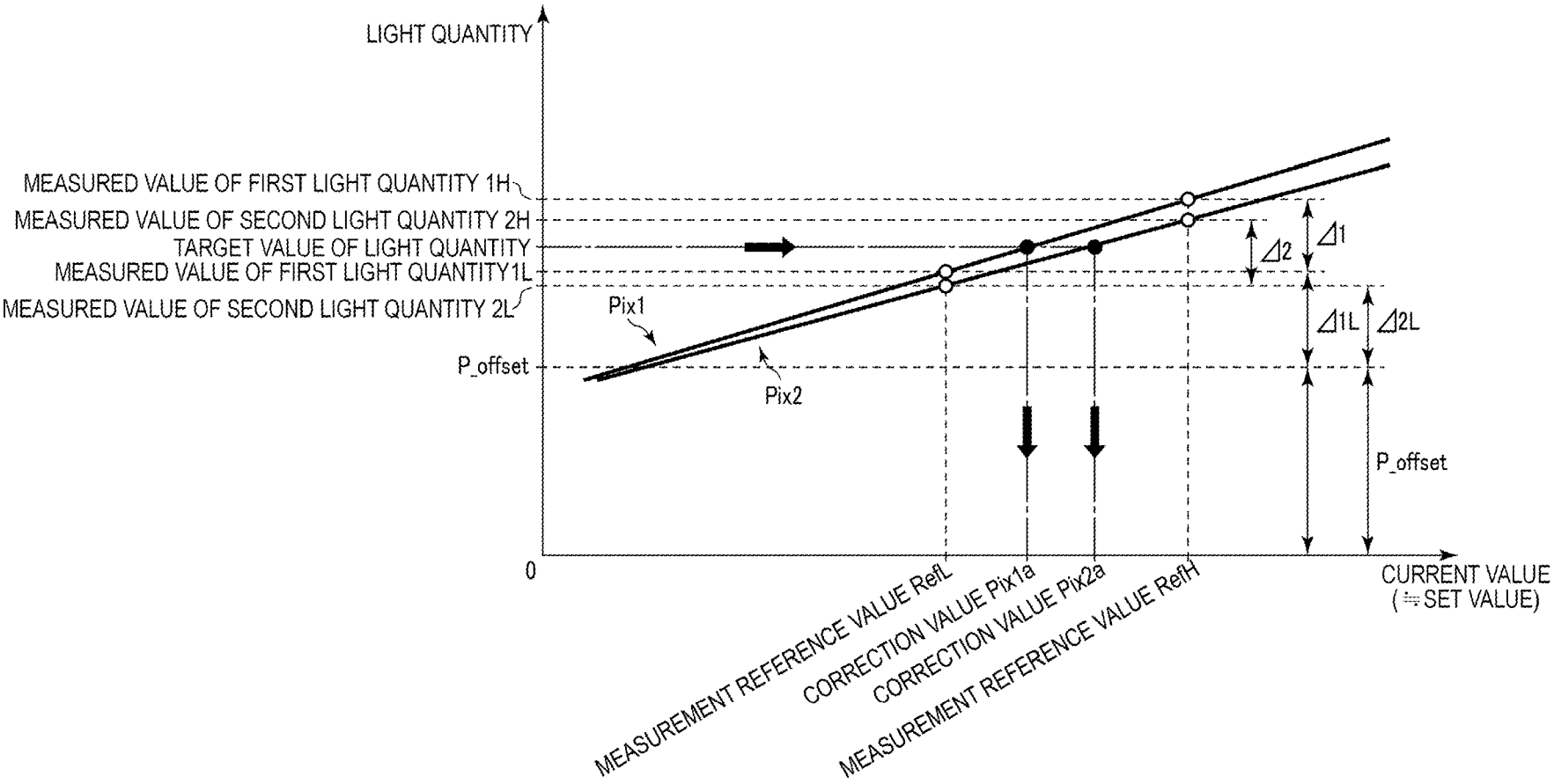
FIG. 4 is a diagram illustrating an example of characteristics of light quantities and current values of light emitting elements of a print head according to a second embodiment.

FIG. 4 is a diagram illustrating an example of characteristics of light quantities and current values of light emitting elements of a print head according to a second embodiment. A difference between the second embodiment and the first embodiment will be mainly described, and the points in common between the second embodiment and the first embodiment will be appropriately omitted.

As illustrated in FIG. 4, an offset reference value P_offset is set in advance based on the relationship between the light quantities and the current values of the light emitting elements. The offset reference value P_offset is set as a value lower than a light quantity that is obtained corresponding to the measurement reference value RefL in consideration of the difference between the light quantities of the individual light emitting elements.

After setting the offset reference value P_offset, the light quantity measuring device converts the measured value of the light quantity and records the converted value. For example, the light quantity measuring device calculates a light quantity difference value Δ1L based on the offset reference value P_offset and the measured value of the first light quantity 1L (Δ1L=1L −P_offset). In addition, the light quantity measuring device calculates a light quantity difference value Δ1 based on the measured value of the first light quantity 1L and the measured value of the first light quantity 1H (Δ1=1H−1L). The light quantity measuring device records the calculated light quantity difference value Δ1L and the calculated light quantity difference value Δ1 (light quantity characteristic data D21: Δ1L, Δ1).

Likewise, the light quantity measuring device calculates a light quantity difference value Δ2L based on the offset reference value P_offset and the measured value of the second light quantity 2L (Δ2L=2L −P_offset). In addition, the light quantity measuring device calculates a light quantity difference value Δ2 based on the measured value of the second light quantity 2L and the measured value of the second light quantity 2H (Δ2=2H−2L). The light quantity measuring device records the calculated light quantity difference value Δ2L and the calculated light quantity difference value Δ2 (light quantity characteristic data D22: Δ2L, Δ2).

In order to make the light quantities of the plurality of light emitting elements 131 of the print head 1 substantially uniform, a target light quantity value is set as illustrated in FIG. 4, and a processor mounted on the image forming apparatus or the like calculates a correction value Pix1*a* for obtaining the target light quantity value from the light quantity difference value Δ1L and the light quantity difference value Δ1. Likewise, the processor calculates a correction value Pix2*a* for obtaining the target light quantity value from the light quantity difference value Δ2L and the light quantity difference value Δ2.

The light quantity measuring device outputs the offset reference value P_offset and the light quantity characteristic data D21 and D22 to the print head 1. The print head 1 receives the offset reference value P_offset and the light quantity characteristic data D21 and D22 through the connector 16, and the first memory 151 stores the offset reference value P_offset and the light quantity characteristic data D21 and D22. As described above, the print head 1 stores the characteristics detection results of the light quantities and the current values of the plurality of light emitting elements 131.

Figure 5:
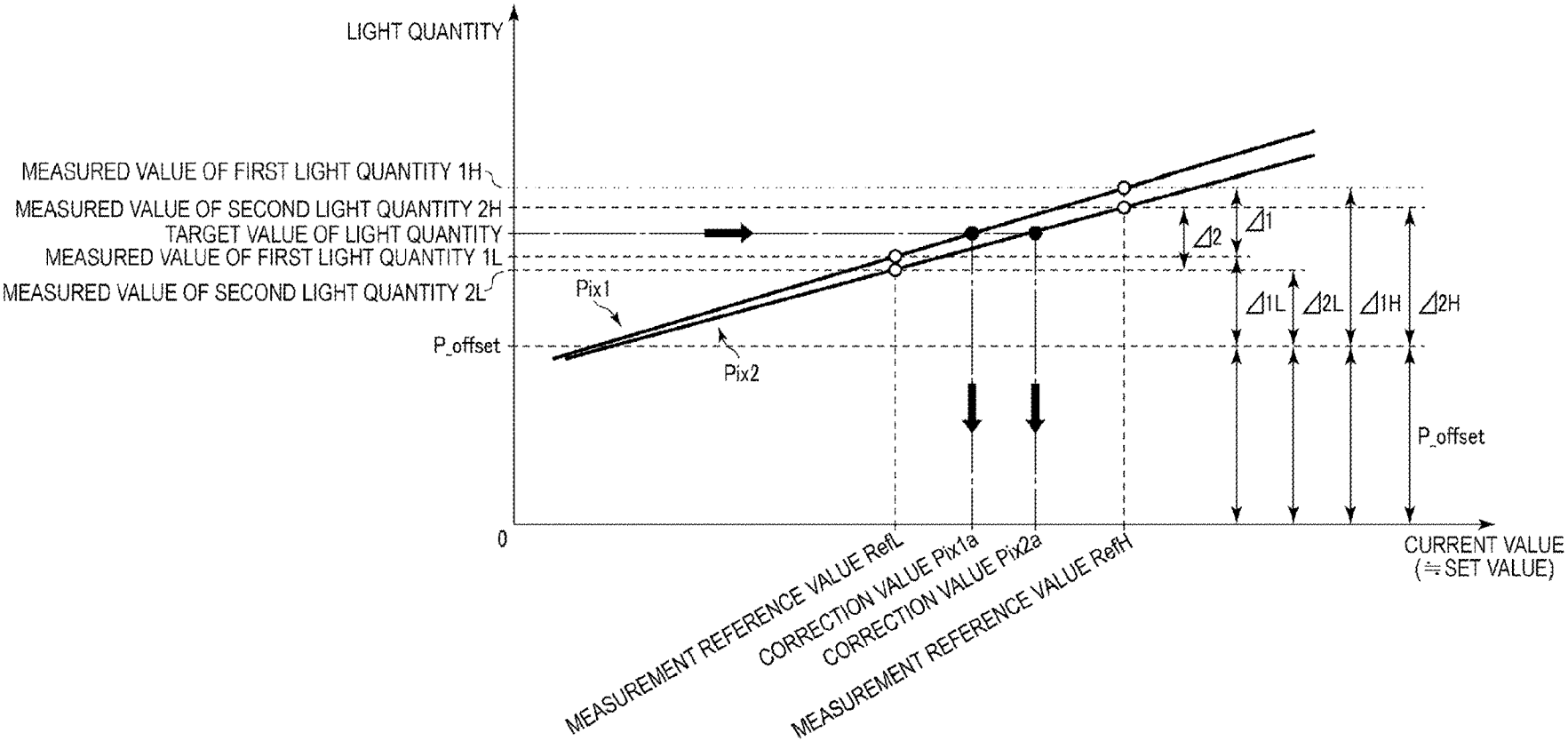
FIG. 5 is a diagram illustrating an example of characteristics of light quantities and current values of light emitting elements of a print head according to a third embodiment.

FIG. 5 is a diagram illustrating an example of characteristics light quantities and current values of light emitting elements of a print head according to a third embodiment. A difference between the third embodiment and the first and second embodiments will be mainly described, and the points in common between the third embodiment and the first and second embodiments will be appropriately omitted.

As illustrated in FIG. 5, after setting the offset reference value P_offset, the light quantity measuring device converts the measured value of the light quantity and records the converted value. For example, the light quantity measuring device calculates a light quantity difference value Δ1L based on the offset reference value P_offset and the measured value of the first light quantity 1L (Δ1L=1L −P_offset). In addition, the light quantity measuring device calculates a light quantity difference value Δ1H based on the offset reference value P_offset and the measured value of first light quantity 1H (Δ1H=1H−P_offset). The light quantity measuring device records the calculated light quantity difference value Δ1L and the calculated light quantity difference value Δ1H (light quantity characteristic data D31: Δ1L, Δ1H).

Likewise, the light quantity measuring device calculates a light quantity difference value Δ2L based on the offset reference value P_offset and the measured value of the second light quantity 2L (Δ2L=2L −P_offset). In addition, the light quantity measuring device calculates a light quantity difference value Δ2H based on the offset reference value P_offset and the measured value of the second light quantity 2H (Δ2H=2H−P_offset). The light quantity measuring device records the calculated light quantity difference value Δ2L and the calculated light quantity difference value Δ2H (light quantity characteristic data D32: Δ2L, Δ2H).

In order to make the light quantities of the light emitting elements 131 of the print head 1 substantially uniform, a target light quantity value is set as illustrated in FIG. 5, and a processor mounted on the image forming apparatus or the like calculates a correction value Pix1*a* for obtaining the target light quantity value from the light quantity difference value Δ1L and the light quantity difference value Δ1H. Likewise, the processor calculates a correction value Pix2*a* for obtaining the target light quantity value from the light quantity difference value Δ2L and the light quantity difference value Δ2H.

The light quantity measuring device outputs the offset reference value P_offset and the light quantity characteristic data D31 and D32 to the print head 1. The print head 1 receives the offset reference value P_offset and the light quantity characteristic data D31 and D32 through the connector 16, and the first memory 151 stores the offset reference value P_offset and the light quantity characteristic data D31 and D32. As described above, the print head 1 stores the characteristics detection results of the light quantities and the current values of the light emitting elements 131.

Figure 6:
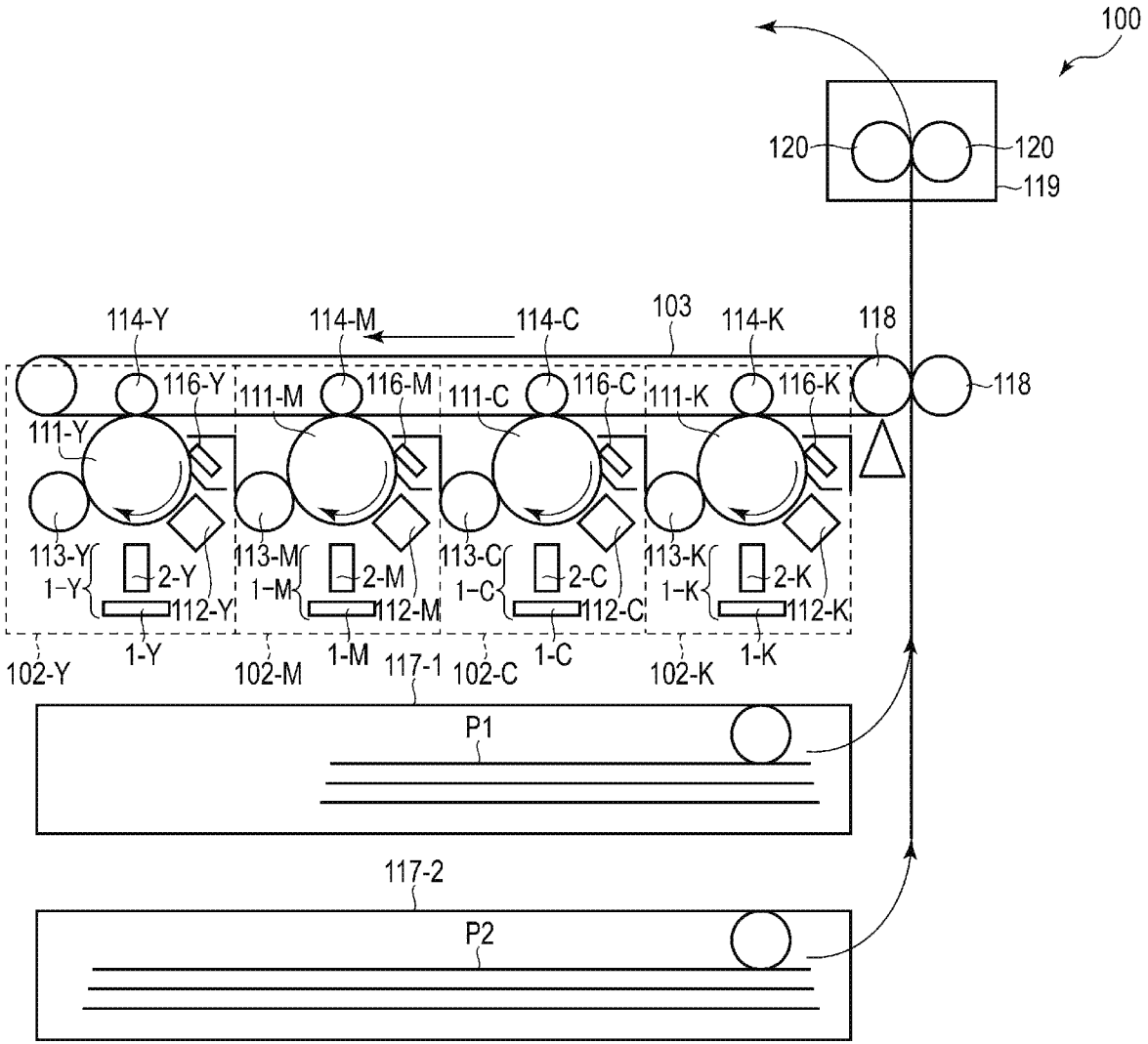
FIG. 6 is a diagram illustrating an example of an image forming apparatus to which the print head common to the respective embodiments is applied.

FIG. 6 is a diagram illustrating an example of an image forming apparatus to which the print head common to the respective embodiments is applied. FIG. 6 illustrates an example of a quadruple-tandem type color image forming apparatus. The print head 1 according to the embodiment is also applicable to a monochrome image forming apparatus.

As illustrated in FIG. 6, for example, the image forming apparatus 100 includes: an image forming unit 102-Y that forms a yellow (Y) image; an image forming unit 102-M that forms a magenta (M) image; an image forming unit 102-C that forms a cyan (C) image; and an image forming unit 102-K that forms a black (K) image. The image forming units 102-Y, 102-M, 102-C, and 102-K form yellow, cyan, magenta, and black images, respectively, and transfer the formed images to a transfer belt 103. As a result, a full-color image is formed on the transfer belt 103.

The image forming unit 102-Y includes an electrostatic charger 112-Y, a print head 1-Y, a developing unit 113-Y, a transfer roller 114-Y, and a cleaner 116-Y, which are provided in the vicinity of a photosensitive drum 111-Y. The image forming units 102-M, 102-C, and 102-K have the same configuration.

In FIG. 6, the reference numeral "-Y" is added to the configurations of the image forming unit 102-Y that forms a yellow (Y) image. The reference numeral "-M" is added to the configurations of the image forming unit 102-M that forms a magenta (M) image. The reference numeral "-C" is added to the configurations of the image forming unit 102-C that forms a cyan (C) image. The reference numeral "-K" is added to the configurations of the image forming unit 102-K that forms a black (K) image.

The electrostatic chargers 112-Y, 112-M, 112-C, and 112-K uniformly charge the photosensitive drums 111-Y, 111-M, 111-C, and 111-K, respectively. The print heads 1-Y, 1-M, 1-C, and 1-K expose the photosensitive drums 111-Y, 111-M, 111-C, and 111-K to the light emitted from the light emitting elements 131 to form electrostatic latent images on the photosensitive drums 111-Y, 111-M, 111-C, and 111-K, respectively. The developing units 113-Y, 113-M, 113-C, and 113-K attach (develop) yellow toner, magenta toner, cyan toner, and black toner to electrostatic latent image portions of the photosensitive drums 111-Y, 111-M, 111-C, and 111-K, respectively.

The transfer rollers 114-Y, 114-M, 114-C, and 114-K transfer the toner images developed on the photosensitive drums 111-Y, 111-M, 111-C, and 111-K to the transfer belt 103. The cleaners 116-Y, 116-M, 116-C, and 116-K clean the toners remaining on the photosensitive drums 111-Y, 111-M, 111-C, and 111-K without being transferred, and enter a standby mode for forming the next image.

Papers (a medium on which an image is to be formed) P1 having a first size (small size) are accommodated in a paper cassette 117-1 which is a paper feed unit. Papers (a medium on which an image is to be formed) P2 having a second size (large size) are accommodated in a paper cassette 117-2 which is a paper feed unit.

The toner images are transferred from the transfer belt 103 to the paper P1 or P2 picked up from the paper cassette 117-1 or 117-2 using a pair of transfer rollers 118 as a transfer unit. The paper P1 or P2 to which the toner images are transferred is heated and pressed by fixing rollers 120 of a fixing unit 119. The toner images are firmly fixed to the paper P1 or P2 by being heated and pressed by the fixing rollers 120. By repeating the above-described process operation, an image forming operation is continuously executed.

The print head 1 of FIGS. 1 and 2 corresponds to the print heads 1-Y, 1-M, 1-C, and 1-K of FIG. 6. In addition, FIG. 6 also illustrates rod lens arrays 2-Y, 2-M, 2-C, and 2-K corresponding to the print heads 1-Y, 1-M, 1-C and 1-K.

Figure 7:
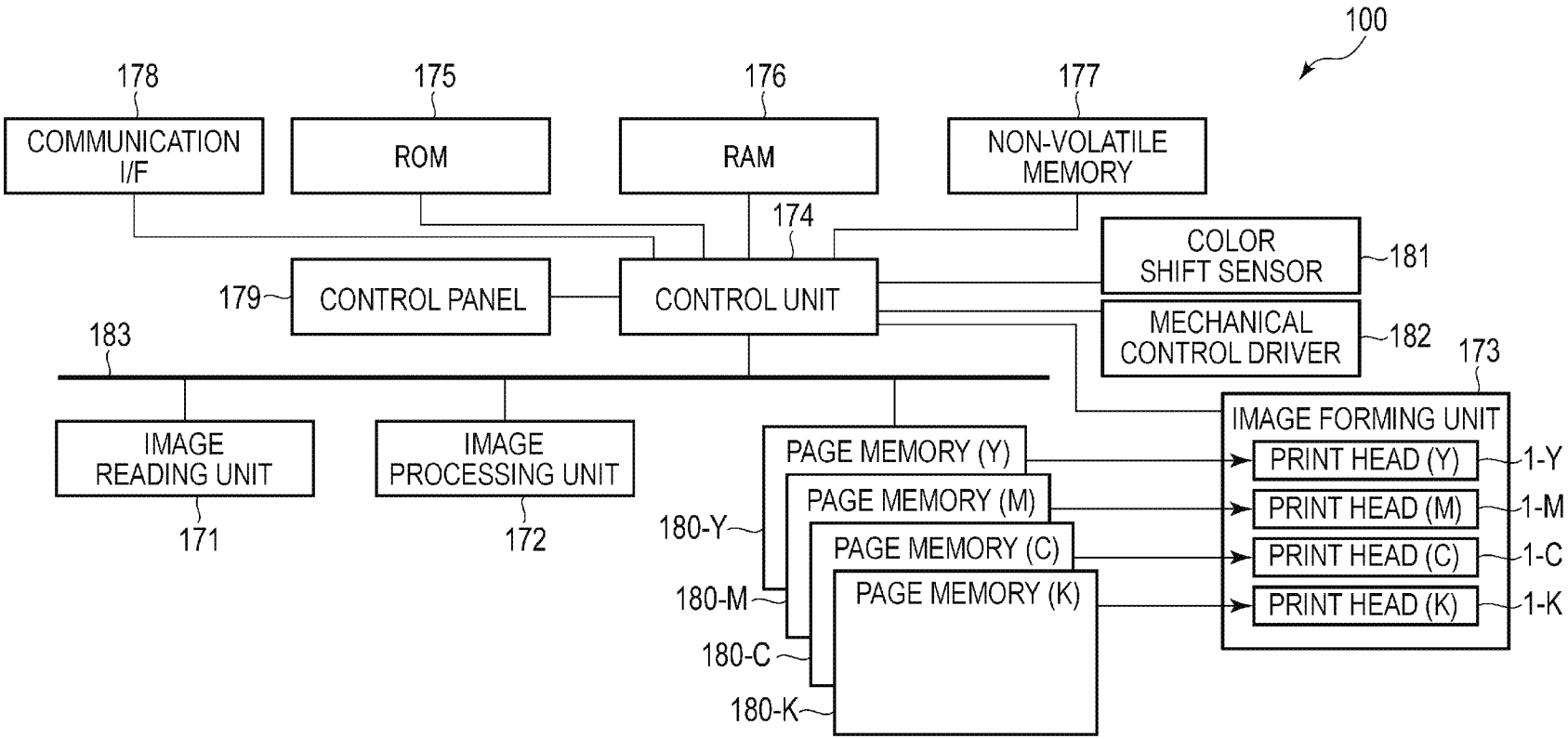
FIG. 7 is a block diagram illustrating an example of a control system of the image forming apparatus to which the print head common to the respective embodiments is applied.

FIG. 7 is a block diagram illustrating an example of a control system of the image forming apparatus to which the print head common to the respective embodiments is applied. As illustrated in FIG. 7, the image forming apparatus 100 includes an image reading unit 171, an image processing unit 172, an image forming unit 173, a control unit 174, a Read Only Memory (ROM) 175, a Random Access Memory (RAM) 176, a non-volatile memory 177, a communication interface (I/F) 178, a control panel 179, page memories 180-Y, 180-M, 180-C, and 180-K, a color shift sensor 181, and a mechanical control driver 182. The image forming unit 173 includes the image forming units 102-Y, 102-M, 102-C, and 102-K.

The ROM 175, the RAM 176, the non-volatile memory 177, the communication I/F 178, the control panel 179, the color shift sensor 181, and the mechanical control driver 182 are connected to the control unit 174.

The image reading unit 171, the image processing unit 172, and the page memories 180-Y, 180-M, 180-C, and 180-K are connected to an image data bus 183. The print heads 1-Y, 1-M, 1-C, and 1-K are connected to the page memories 180-Y, 180-M, 180-C, and 180-K corresponding thereto respectively.

The control unit 174 is configured with one or more processors and controls operations such as an image reading operation, an image processing operation, and an image forming operation in accordance with various programs stored in at least one of the ROM 175 and the non-volatile memory 177. The image forming operation includes the light emission of the light emitting elements 131 of the print head 1, and the control unit 174 controls the light emission of the light emitting elements 131 of the print head 1 based on image data.

The ROM 175 stores various programs and the like required for the control of the control unit 174. The RAM 176 temporarily stores data required for the control of the control unit 174. The non-volatile memory 177 stores an updated program and various parameters and the like. The non-volatile memory 177 may store some or all of various programs.

A mechanical control driver 182 controls operations of motors and the like required for printing in accordance with an instruction of the control unit 174. The communication I/F 178 may output or input various pieces of information to or from the outside of the image forming apparatus 100, or may output or input various pieces of information to or from each of the units of the image forming apparatus 100. For example, the image forming apparatus 100 prints image data input through the communication I/F 178 using a print function. The control panel 179 receives an operation input from a user or a service person.

The image reading unit 171 optically reads an image of an original document to acquire image data and outputs the image data to the image processing unit 172. The image processing unit 172 executes various kinds of image processing (including correction) on the image data input through the communication I/F 178 or the image data input from the image reading unit 171. The page memories 180-Y, 180-M, 180-C, and 180-K store respective color components (Y, M, C, K) of the image data processed by the image processing unit 172. The control unit 174 loads the respective color components of the image data to the page memories 180-Y, 180-M, 180-C, and 180-K and controls the image formations of the print heads 1-Y, 1-M, 1-C, and 1-Y. The image forming unit 173 includes the print heads 1-Y, 1-M, 1-C, and 1-K and forms images based on the various color components of the image data loaded to the page memories 180-Y, 180-M, 180-C, and 180-K.

In addition, the control unit 174 inputs test patterns to the page memories 180-Y, 180-M, 180-C, and 180-K to form the test patterns. The color shift sensor 181 detects the test patterns formed on the transfer belt 103 and outputs a detection signal to the control unit 174. The control unit 174 can recognize the positional relationship between the test patterns of the respective colors from the input of the color shift sensor 181.

The control unit 174 selects the paper cassette 117-1 or 117-2 that feeds paper on which an image is to be formed through the mechanical control driver 182.

Figure 8:
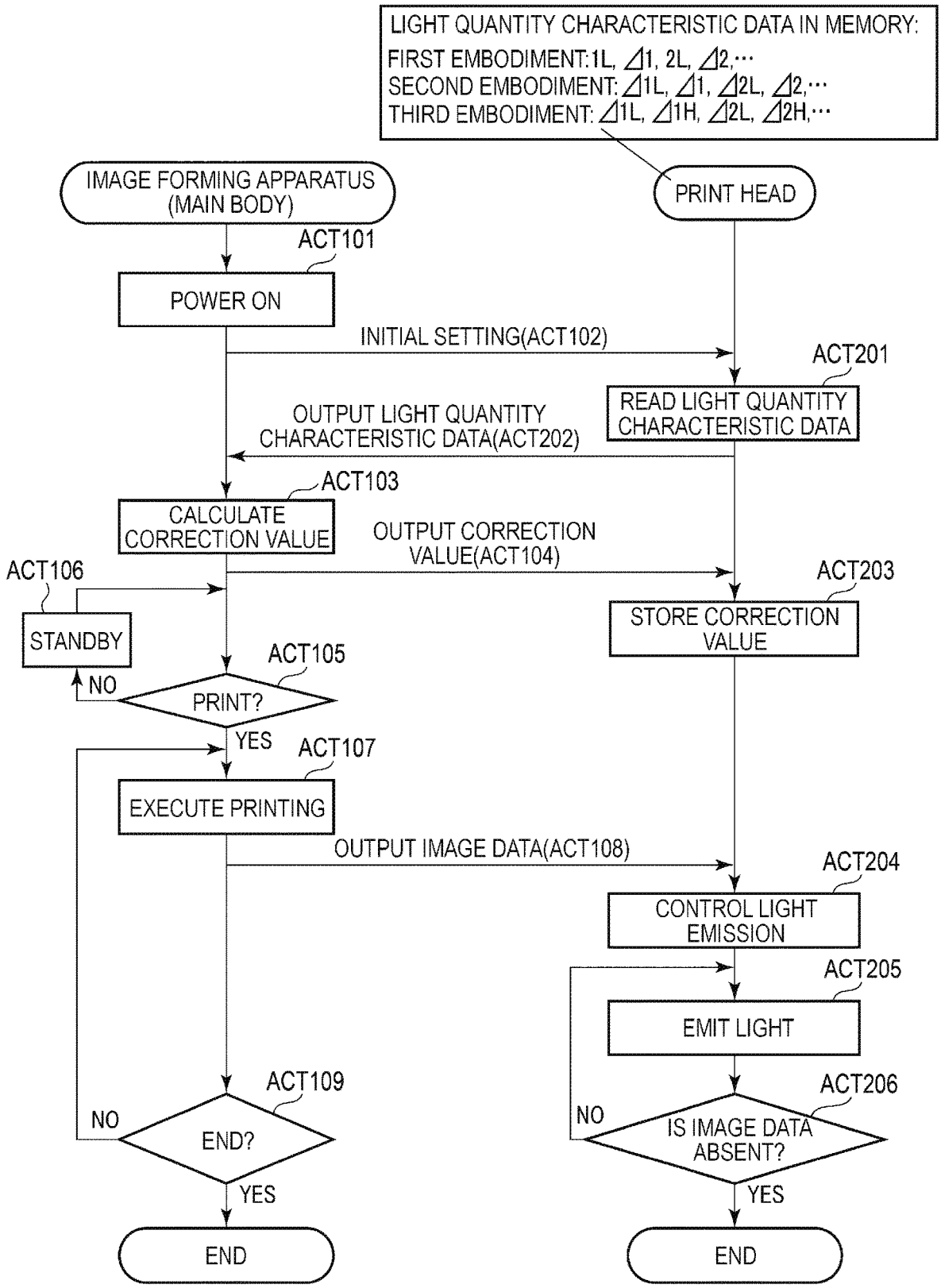
FIG. 8 is a flowchart illustrating an example of a light quantity control of the image forming apparatus common to the respective embodiments.

FIG. 8 is a flowchart illustrating an example of a light quantity control of the image forming apparatus common to the respective embodiments.

As illustrated in FIG. 8, when the user operates a power switch to supply power to the image forming apparatus 100, the image forming apparatus 100 turns on (ACT 101). The control unit 174 of the image forming apparatus 100 executes initial setting based on the program stored in the ROM 175 and the like (ACT 102).

Here, an operation of storing a target light quantity value using the image forming apparatus 100 will be described. For example, the non-volatile memory 177 stores a target light quantity value for the print head 1. The target light quantity value is a value that is set according to the operation performance and the like of the image forming apparatus 100, and a target light quantity value of the image forming apparatus 100 corresponding to high-speed printing and a target light quantity value of the image forming apparatus 100 corresponding to normal-speed printing are different from each other. When shipping the image forming apparatus 100, the non-volatile memory 177 stores the target light quantity value corresponding to the operation performance. In addition, after shipping, the communication I/F 178 may receive a target light quantity value from an external server or the like such that the target light quantity value stored in the non-volatile memory 177 is updated to the received target light quantity value.

Alternatively, the control unit 174 may estimate a decrease in the light quantity caused by deterioration over time based on the number of printed sheets such that the target light quantity value stored in the non-volatile memory 177 is updated. As described above, the target light quantity value is not a fixed value but a value that is updated according to the operation performance or the usage state.

The control unit 174 communicates with the print head 1 through the communication I/F 178, the control circuit 15 of the print head 1 reads light quantity characteristic data of the first memory 151 (ACT 201), and the connector 16 outputs the light quantity characteristic data (ACT 202). In the print head 1 according to the first embodiment, 1L, Δ1, 2L, Δ2, and the like are output as the light quantity characteristic data. In the print head 1 according to the second embodiment, Δ1L, Δ1, Δ2L, Δ2, and the like are output as the light quantity characteristic data. In the print head 1 according to the third embodiment, Δ1L, Δ1H, Δ2L, Δ2H, and the like are output as the light quantity characteristic data.

The control unit 174 receives the light quantity characteristic data from the print head 1 through the communication I/F 178, and calculates a correction value for obtaining the target light quantity value stored in the non-volatile memory 177 from the light quantity characteristic data (ACT 103). In the case where the print head 1 according to the first embodiment is applied, the correction value Pix1*a*, the correction value Pix2*a*, and the like are calculated based on the target light quantity value and the light quantity characteristic data (1L, Δ1, 2L, Δ2, and the like). In the case where the print head 1 according to the second embodiment is applied, the temporary correction value Pix1*a*, the temporary correction value Pix2*a*, and the like are calculated based on the target light quantity value and the light quantity characteristic data (Δ1L, Δ1, Δ2L, Δ2, and the like). In the case where the print head 1 according to the third embodiment is applied, the temporary correction value Pix1*a*, the temporary correction value Pix2*a*, and the like are calculated based on the target light quantity value and the light quantity characteristic data (Δ1L, Δ1H, Δ2L, Δ2H, and the like).

In the second embodiment, the offset reference value P_offset is used, and some values (Δ1L, Δ2L, and the like) of the light quantity characteristic data are shifted values. Therefore, the temporary correction value is calculated instead of a correction value that can be actually used. In the third embodiment, the offset reference value P_offset is used, and the light quantity characteristic data (Δ1L, Δ1H, Δ2L, Δ2H, and the like) are shifted values. Therefore, the temporary correction value is calculated instead of a correction value that can be actually used.

The control unit 174 outputs the correction value through the communication I/F 178 (ACT 104). The print head 1 inputs the correction value through the connector 16, and the second memory 152 stores the correction value (ACT 203).

When the image forming apparatus 100 does not receive a printing execution request (ACT 105, NO), the image forming apparatus 100 transitions to a standby mode (ACT 106). When the image forming apparatus 100 receives a printing execution request (ACT 105, YES), the control unit 174 instructs to execute printing (ACT 107) and outputs the image data (ACT 108), thereby causing the image forming unit 173 to form an image.

The print head 1 receives image data through the connector 16, the drive circuit array 14 controls the light emission of each of the light emitting elements 131 based on the image data and the correction value (ACT 204), and each of the light emitting elements 131 emits light at the target light quantity according to the correction current value corresponding to the image data and the correction value (ACT 205). In the second and third embodiments, the temporary correction value is converted into a correction value that is actually used based on the offset reference value P_offset, and the light emission of each of the light emitting elements 131 is controlled based on the converted correction value and the image data.

In the above description, the first memory 151 of the print head 1 stores the offset reference value P_offset, and the temporary correction value is converted into a correction value that is actually used based on the offset reference value P_offset. However, the non-volatile memory 177 or the like of the image forming apparatus 100 may store the offset reference value P_offset, and the temporary correction value may be converted into a correction value that is actually used based on the offset reference value P_offset.

Until the image data is absent (ACT 206, NO), each of the light emitting elements 131 emits light at the target light quantity according to the image data (ACT 205). When the image data is absent (ACT 206, YES), the light emission is stopped, and the operation of the print head 1 ends. In addition, the control unit 174 of the image forming apparatus 100 ends the printing in response to the print execution request (ACT 109, YES), and if there is no next print execution request, the operation of the image forming apparatus 100 ends.

Here, various operations will be supplemented. As described above, in the image forming apparatus 100, the light quantity characteristic data is read and output at the initial setting stage before a printing execution request is issued, and thus, a correction value before the issue of the printing execution request can be stored, and the efficiency of the printing operation can be improved.

In addition, the control unit 174 may store the calculated correction value in the non-volatile memory 177. During the next power-on, the control unit 174 outputs the correction value stored in the non-volatile memory 177 to the print head 1 without calculating the correction value, and the efficiency of the print operation can be improved. Alternatively, the print head 1 may store the correction value in the first memory 151, and may skip the reading and output of the light quantity characteristic data in the next power-on.

In addition, the control unit 174 may estimate a decrease in the light quantity caused by deterioration over time based on the number of printed sheets to calculate the correction value. For example, when the number of printed sheets exceeds a predetermined number, the control unit 174 outputs a second correction value higher than a first correction value that is output before the number of printed sheets exceeds the predetermined number. For example, when the first correction value is stored in the non-volatile memory 177, the control unit 174 updates the first correction value of the non-volatile memory 177 to the second correction value. In addition, when the first correction value is stored in the first memory 151 of the print head 1, the control unit 174 outputs the second correction value, and the print head 1 updates the first correction value of the first memory 151 to the second correction value.

Next, the effects obtained by storing the light quantity characteristic data in each of the embodiments will be described. For example, as a comparative example, a case is assumed where the measured value of the first light quantity 1L and the measured value of the first light quantity 1H are recorded (light quantity characteristic data D01: 1L, 1H) and the measured value of the second light quantity 2L and the measured value of the second light quantity 2H are recorded (light quantity characteristic data D02: 2L, 2H). That is, a case where measured values of light quantities at two points are recorded is assumed. The effects obtained by storing the light quantity characteristic data in each of the embodiments will be described with reference to the comparative example.

Since the light quantity difference values are employed in some values of the light quantity characteristic data (D11, D12) described in the first embodiment, the amount of data can be reduced. In addition, when the same amount of data as that of the comparative example is used, the data accuracy can be enhanced. By obtaining the high-accuracy light quantity difference value, the light quantities of the respective light emitting elements can be made to be uniform with high accuracy, which also contributes to the improvement of image quality. In addition, when the correction value is calculated, it is not necessary to calculate the difference (1H−1L) in the step of calculating the slope (1H−1L)/(RefH−RefL), which can also contribute to the improvement of the performance of the correction process.

In the light quantity characteristic data (D21, D22) described in the second embodiment and the light quantity characteristic data (D31, D32) described in the third embodiment, the offset reference value P_offset is adopted. Therefore, the amount of data can be further reduced as compared to the first embodiment. In addition, when the same amount of data as that of the comparative example is used, the data accuracy can be further enhanced. By obtaining the high-accuracy light quantity difference value, the light quantities of the respective light emitting elements can be made to be uniform with higher accuracy, which also contributes to the further improvement of image quality. In addition, as in the first embodiment, when the correction value is calculated, the performance of the correction process can be improved.

Figure 9:
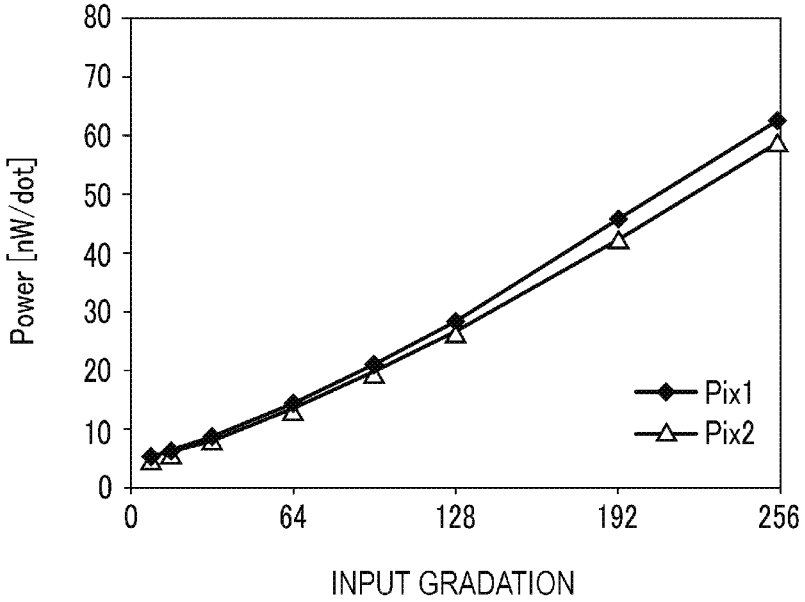
FIG. 9 is a diagram illustrating the effect of reducing the amount of data which is common to the respective embodiments.

FIG. 9 is a diagram illustrating the effect of reducing the amount of data which is common in each of the embodiments. Here, the horizontal axis (input gradation) of FIG. 9 will be supplemented. For example, it is assumed that a signal that is D/A converted from 8-bit data is input to the drive circuit, and the drive circuit applies a current value based on the input signal to the light emitting elements. The horizontal axis represents a ratio of the applied current value with respect to 256 as the maximum current value to be applied to the light emitting elements. The variable range of the current value is set as 1 to 256.

For example, by adopting the light quantity characteristic data described in the embodiments and representing 20 to 50 [nW/dot] by 8 bit, the data accuracy can be further improved as compared to a case where 0 to 80 [nW/dot] of the vertical axis is represented by 8 bit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A print head comprising:

a plurality of light emitting elements configured to emit light;

a memory configured to store a first light quantity value obtained by measuring a light quantity of each of the plurality of light emitting elements that emit light when supplied with a first reference current value, and a light quantity difference value between the first light quantity value and a second light quantity value obtained by measuring a light quantity of each of the plurality of light emitting elements that emit light when supplied with a second reference current value; and an input and output unit configured to:

output the first light quantity value and the light quantity difference value; and receive a correction value determined based on the first light quantity value and the light quantity difference value;

wherein each of the plurality of light emitting elements is configured to emit light based on a correction current value corresponding to the correction value.

2. The print head of claim 1, wherein the first light quantity value is a first measured value of a first light quantity that is obtained by measuring the light quantity of each of the plurality of light emitting elements, and wherein the second light quantity value is a second measured value of a second light quantity that is obtained by measuring the light quantity of each of the plurality of light emitting elements.

3. The print head of claim 1, wherein the first light quantity value is a first value determined by subtracting an offset reference value from a first measured value of a first light quantity that is obtained by measuring the light quantity of each of the plurality of light emitting elements, and wherein the second light quantity value is a second value determined by subtracting the offset reference value from a second measured value of a second light quantity that is obtained by measuring the light quantity of each of the plurality of light emitting elements.

4. The print head of claim 1, wherein the correction value is a value for obtaining a substantially uniform target light quantity from each of the plurality of light emitting elements based on characteristics of light quantities and current values of each of the plurality of light emitting elements.

5. The print head of claim 1, wherein the input and output unit is configured to interface with an image forming apparatus, and wherein the image forming apparatus includes a control unit configured to determine the correction value.

6. The print head of claim 1, wherein the plurality of light emitting elements include light emitting diodes.

7. The print head of claim 6, wherein the light emitting diodes include organic light emitting diodes.

8. An image forming apparatus comprising:

an image forming unit including a print head comprising:

a plurality of light emitting elements configured to emit light;

a memory configured to store a first light quantity value obtained by measuring a light quantity of each of the plurality of light emitting elements that emit light when supplied with a first reference current value, and a light quantity difference value between the first light quantity value and a second light quantity value obtained by measuring a light quantity of each of the plurality of light emitting elements that emit light when supplied with a second reference current value; and an input and output unit configured to:

output the first light quantity value and the light quantity difference value; and receive a correction value determined based on the first light quantity value and the light quantity difference value; and a control unit configured to determine the correction value based on the first light quantity value and the light quantity difference value;

wherein each of the plurality of light emitting elements of the print head is configured to emit light based on image data and a correction current value corresponding to the correction value; and wherein the image forming unit is configured to form an image corresponding to the image data based on light emission of each of the plurality of light emitting elements.

9. The image forming apparatus of claim 8, wherein the first light quantity value is a first measured value of a first light quantity that is obtained by the image forming unit by measuring the light quantity of each of the plurality of light emitting elements when provided the first reference current value.

10. The image forming apparatus of claim 9, wherein the second light quantity value is a second measured value of a second light quantity that is obtained by the image forming unit by measuring the light quantity of each of the plurality of light emitting elements when provided the second reference current value.

11. The image forming apparatus of claim 8, wherein the first light quantity value is a first value determined by the image forming unit by subtracting an offset reference value from a first measured value of a first light quantity that is obtained by the image forming unit by measuring the light quantity of each of the plurality of light emitting elements when provided the first reference current value.

12. The image forming apparatus of claim 11, wherein the second light quantity value is a second value determined by the image forming unit by subtracting the offset reference value from a second measured value of a second light quantity that is obtained by the image forming unit by measuring the light quantity of each of the plurality of light emitting elements when provided the second reference current value.

13. The image forming apparatus of claim 8, wherein the correction value is a value for obtaining a substantially uniform target light quantity from each of the plurality of light emitting elements based on characteristics of light quantities and current values of each of the plurality of light emitting elements.

14. The image forming apparatus of claim 8, wherein the plurality of light emitting elements include light emitting diodes.

15. The image forming apparatus of claim 14, wherein the light emitting diodes include organic light emitting diodes.

16. A method for operating an image forming apparatus, the method comprising:

providing, by a control circuit of an image forming unit of the image forming apparatus, a first reference current value to each of a plurality of light emitting elements of the image forming unit;

acquire, by the control circuit, a first value corresponding with a first light quantity value that is associated with a quantity of light emitted by each of the plurality of light emitting elements in response to being provided the first reference current value;

providing, by the control circuit, a second reference current value to each of the plurality of light emitting elements;

acquire, by the control circuit, a second value corresponding with a second light quantity value that is associated with the light quantity of light emitted by each of the plurality of light emitting elements in response to being provided the second reference current value;

transmitting, via an interface of the image forming unit, the first light quantity value and the second light quantity value for each of the plurality of light emitting elements to a control unit of the image forming apparatus;

determining, by the control unit, a correction value for each of the plurality of light emitting elements based at least on (i) the first light quantity value and the second light quantity value for each of the plurality of light emitting elements and (ii) a target light quantity value;

providing, by the control unit, the correction value to the interface; and controlling, by the control circuit, each of the plurality of light emitting elements to emit light based on image data and a correction current value corresponding to the correction value to form an image corresponding to the image data based on light emission from each of the plurality of light emitting elements.

17. The method of claim 16, wherein the first light quantity value is the first value acquired by the control circuit and the second light quantity value is the second value acquired by the control circuit.

18. The method of claim 16, further comprising:

determining, by the control circuit, the first light quantity value by subtracting an offset reference value from the first value; and determining, by the control circuit, the second light quantity value by subtracting the offset reference value from the second value.

19. The method of claim 16, wherein the plurality of light emitting elements include light emitting diodes.

20. The method of claim 19, wherein the light emitting diodes include organic light emitting diodes.

* * * * *